United States Patent [19]

Beyl

[11] 4,358,132

[45] Nov. 9, 1982

[54] MULTIDIRECTIONAL RELEASE SAFETY SKI BINDING

[75] Inventor: Jean J. A. Beyl, Nievre, France

[73] Assignee: Look S.A., Nievre, France

[21] Appl. No.: 13,167

[22] Filed: Feb. 21, 1979

[30] Foreign Application Priority Data

Mar. 3, 1978 [FR] France ..... 78 06102
Oct. 27, 1978 [FR] France ..... 78 30571

[51] Int. Cl.[3] ..... A63C 9/00
[52] U.S. Cl. ..... 280/628
[58] Field of Search ..... 280/628, 626, 629, 630, 280/631, 632, 623, 625

[56] References Cited

U.S. PATENT DOCUMENTS

| | | | |
|---|---|---|---|
| 3,027,173 | 3/1962 | Beyl | 280/629 |
| 3,693,989 | 9/1972 | Forcht | 280/628 |
| 3,709,510 | 1/1973 | Gotz | 280/628 |
| 3,722,902 | 3/1973 | Marker | 280/628 |
| 4,081,186 | 3/1978 | Beyl | 280/628 X |

*Primary Examiner*—Joseph F. Peters, Jr.
*Assistant Examiner*—Milton L. Smith
*Attorney, Agent, or Firm*—Bierman & Bierman

[57] ABSTRACT

A safety ski binding includes an end piece engageable with a ski boot and horizontally pivotable on a body rotatably mounted on a pivot member carried on the surface of a ski for vertical pivotability with respect to the ski. The vertical pivot member includes two diametrically opposed cam faces movable in the longitudinal direction of the ski, each of the cam faces being engaged by a separate piston while being urged by a common spring. The end piece is adapted to move one of the two pistons away from the corresponding cam surface on vertical movement of the end piece. A modified embodiment of the invention utilizes a single piston and the spring controls the release of the ski boot under both side torsion stresses and vertical movements of the ski boot end associated with the binding when they exceed predetermined and adjustable limit values.

14 Claims, 15 Drawing Figures

MULTIDIRECTIONAL RELEASE SAFETY SKI BINDING

BACKGROUND OF THE INVENTION

This invention relates in general to safety ski bindings and has specific reference to bindings of the kind referred to more particularly as "multidirectional ski bindings", that is; ski bindings capable of producing both a lateral release and a vertical release of the ski boot under abnormal stress conditions.

As a rule and preferably, a ski binding of this type is mounted on the ski in such a manner that it cooperates with the toe end of the boot to permit the release thereof in case of torsional and/or backward fall of the skier. It could as well be used in conjunction with the heel end of the ski boot in case of torsional stress and/or forward fall of the skier.

To this end, the ski binding contemplated by the present invention comprises a boot retaining jaw, also called an end piece, pivoted in relation to the body of the device about an axis parallel to the top surface of the ski and perpendicular to the longitudinal axis thereof, the body proper being adapted to rotate about the axis of a pivot member secured to the ski and extending at right angles thereto. In the following disclosure, these two axes will be referred to as the "horizontal axis" and the "vertical axis", respectively.

The ski binding according to the present invention is also of the type wherein the body is held against movement on the vertical pivot member by means of a pair of sliding pistons carried by the body and resiliently urged against complementary cam faces formed integrally with the pivot member proper. The essential advantages characterizing safety ski bindings of this character are their great simplicity and sturdiness, the reliability of the resilient return means even in case of relatively ample angular movement of the body, and the considerable resistance of the device to shocks and jolts.

The safety ski binding contemplated in the present invention also pertains to the type wherein an upward movement of the toe device which is due either to the presence of snow under the ski boot or to a momentary forward bending of the skier's body is not attended by an increment in the torque tending to retain the ski binding body against rotation about the pivot member. This property is highly desirable from the standpoint of safety in a ski binding.

The present state of the art may be illustrated for example by reference to the French Pat. No. 69.19153. The ski binding shown in FIG. 3 of this patent comprises a jaw pivoted about a horizontal axis on the body pivoted in turn about a vertical axis. The body is held against movement in relation to both pivot means by the provision of a pair of pistons each urged by a separate spring against a pair of flat cam or flat faces formed on the vertical pivot member proper.

The end piece is held against movement in relation to the horizontal axis by means of a ball urged by a third spring. A pivoting lever is provided for transmitting the movement from the ball to one of the springs holding the body against rotation, so that when the toe piece is lifted the spring is released and the resilient pressure exerted by the relevant piston on the pivot means decreases. On the other hand, the other piston keeps bearing with the same force against the corresponding flat face. The total torque resiliently counteracting the torsion stress is thus reduced in case of upward tilting movement of the toe or end piece.

However, this device is objectionable on account of the presence of three springs which increase both the final cost and the over-all dimensions of the binding beyond reasonable limits.

SUMMARY OF THE INVENTION

It is the essential object of the present invention to provide a safety ski binding of the type broadly set forth hereinabove but characterized by a simpler, more compact and economical construction.

The safety ski binding according to this invention comprises essentially a vertical pivot member formed with two diametrically opposed cam means. The body of the binding comprises two pistons movable in the longitudinal direction of the ski and a single resilient member constantly urging both pistons against the corresponding cam means of the pivot member. The end piece is provided with at least one ramp engaged by a follower adapted to move one of the two pistons away from the relevant cam when the end piece is moved upwards.

According to a first form of embodiment of the safety ski binding of this invention, one of the pistons is adapted to slide within the body and has substantially the shape of a frame or open-sided box in which the other piston is adapted to slide, said frame surrounding at the same time the pivot member, the resilient member and the other piston.

According to a second form of embodiment of the safety ski binding of this invention, means are provided for moving the end piece towards the boot when the body is caused to rotate about the vertical axis of the pivot member.

In this specific form of embodiment, the cam means consist simply of flat faces extending vertically across the ski, and one of the pistons is either an integral portion of the body or a separate insert secured to the body. This body comprises an elongated bore permitting the mounting thereof on the vertical pivot member and the movement thereof towards the boot. The other piston is guided within the body and the follower in the form of a transverse rod extends through this piston.

When the body is caused to rotate, the latter and consequently the end piece are driven towards the boot and tend to compress the boot. Thus, a very satisfactory torsional resilient return force is obtained even if the ski binding has not been accurately fitted to the ski boot size, this ski binding being very moderately sensitive to an inaccurate longitudinal adjustment.

According to a third form of embodiment, the end piece is movable towards the ski boot not only when the body is caused to rotate about the vertical pivot member but also when the end piece is lifted by rotating about a horizontal pivot axis. This form of embodiment departs from the preceding one in that the transverse rod constituting the follower is interposed between the flat cam face of the vertical pivot member which is directed towards the boot and the flat portion of the body which coacts with this flat face. When the end piece is lifted by rotating about the horizontal axis the cam face (or faces) rigid with the end piece urges (or urge) the rod against the vertical pivot member. Since the rod abuts the vertical pivot member, the body is caused to move forcibly towards the boot. When the end piece is lifted the rod reacts against an annular groove formed around the vertical pivot member so as to avoid any interference with the rotational movement of the body about the vertical pivot member.

The rotation of the end piece about either of the horizontal and vertical axes is thus attended by its movement and also by that of the body of the device towards the ski boot. Under these conditions the boot is accompanied by the end piece along a relatively long stroke before escaping outwardly from the binding, so that the risks of untimely release in case of moderately dangerous shock are reduced. Moreover, a very satisfactory resilient return rate is obtained, irrespective of the direction in which the fall occurs.

Other features and advantages of the invention will appear as the following description proceeds with reference to the accompanying drawings illustrating diagrammatically by way of example three modified forms of embodiment of the safety ski binding according to the present invention.

DESCRIPTION OF THE PREFERRED EMBODIMENTS

The safety ski binding shown in FIGS. 1 to 5 of the drawings is intended more particularly but not exclusively for cooperating with the toe end of a ski boot. It comprises an end piece E adapted to pivot against a resilient force both about a first horizontal axis h and about a second vertical axis v, the plane 10 or top surface of the ski being assumed to be horizontal, in order to simplify the description.

Figure 3:
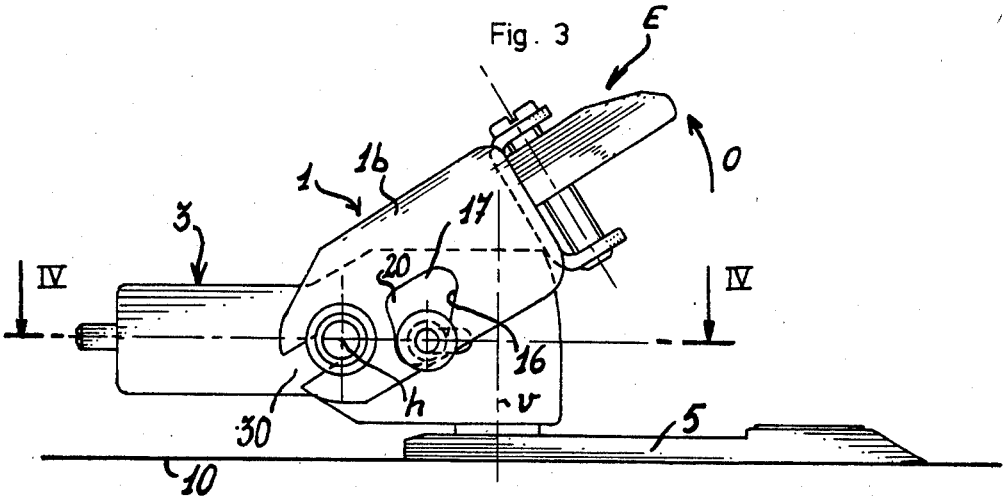
FIG. 3 is a side elevational view of the ski binding of FIGS. 1 and 2, of which the end piece has pivoted through a certain angle about the horizontal axis.

The first horizontal axis h is coincident with the common axis of a pair of opposed laterally spaced trunnions 2 projecting from a body 3 fulcrumed on a vertical pivot member 4 of which the axis is the second or vertical axis v; this pivot member 4 is rigidly secured to the ski. The end piece E is mounted on a strap 1 of which the lateral arms 1*a* and 1*b* encompass the body 3 of the ski binding, the trunnions 2 engaging the bottoms of corresponding notches 30 formed in the outer ends of said lateral arms 1*a* and 1*b*. The end piece E is thus adapted to pivot about the trunnions 2, as shown in FIG. 3.

In a manner known per se, the base of the vertical pivot member 4 is fitted into a plate 5 fastened in turn to the ski by means of screws. The end piece E consists essentially of a V-shaped jaw 6 adapted to retain the ski boot.

The vertical pivot member 4 having the vertical axis v as its fulcrum axis comprises a first portion 7 consisting of a flat cam face engaged by a first piston 8 housed within the body 3 and urged against said flat cam face by a coil compression spring 9. The latter surrounds an axial rod 11 of which the ends extend on the one hand through the piston 8 and on the other hand through the end of the body 3 which is opposite the pivot member 4, the spring 9 penetrating into a cavity 12 formed in said piston 8. Thus, the piston 8 is constantly urged by the spring 9 against the cam means consisting of the vertical flat face 7, so that the body 3 is normally held against rotation about the second axis v.

The end of rod 11 passing through the piston 8 is screw-threaded and engages a corresponding tapped hole formed in this piston, so that it can be adjusted in relation thereto to modify at will the pressure of spring 9 by simply rotating the rod 11. In fact, the rod 11 comprises a collar 21 engaging a corresponding cavity formed in piston 8, the spring 9 bearing with one end against said collar 21.

Figure 2:
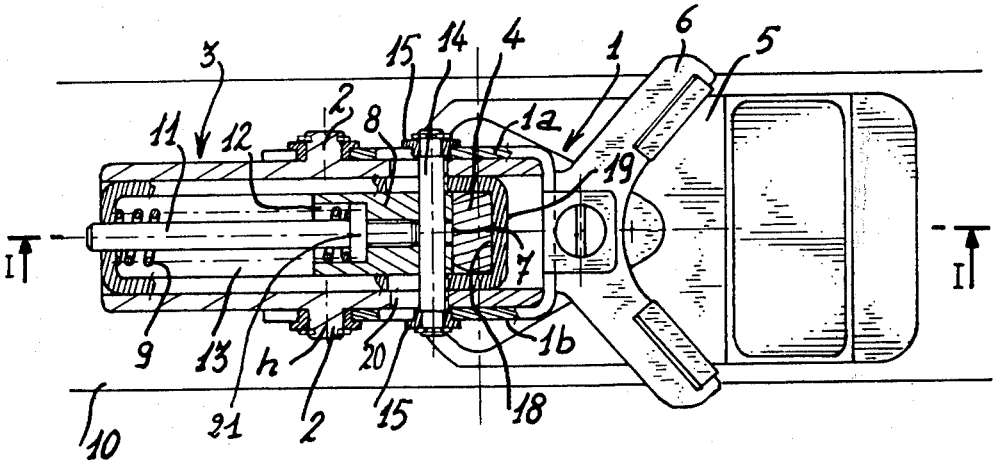
FIG. 2 is a plan view from above and in section taken along the line II—II of FIG. 1.

In FIG. 2, the screw 11 is shown as being screwed home in the tapped hole, so that the spring has its maximal expansion.

This piston 8 is slidably mounted in a cavity 13 of body 3 which has its axis parallel to the longitudinal center line of the ski. Complementarily, this piston 8 carries a follower 14 consisting in this example of a transverse rod extending diametrally through the piston 8 and projecting from either side thereof and also externally of the body 3 through elongated apertures 20 formed therein. The ends of this rod 14 are advantageously provided with anti-friction rollers 15 bearing against a pair of ramps or cam faces 16 formed on the edges of apertures or notches 17 formed in the side arms 1*a* and 1*b*.

Figure 1:
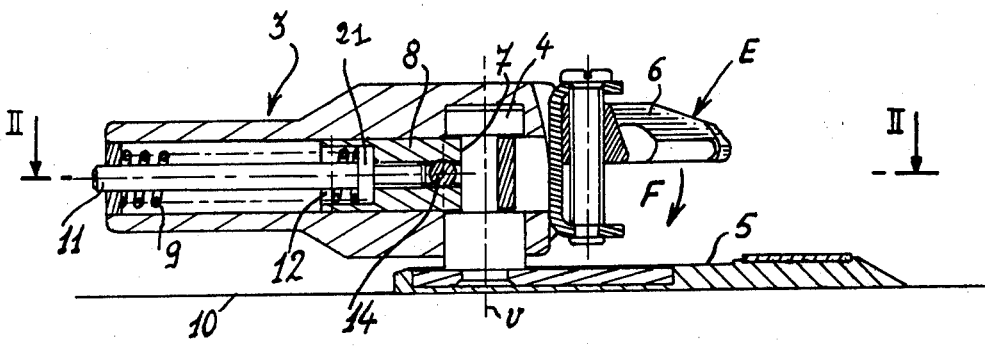
FIG. 1 is a longitudinal section taken along the line I—I of FIG. 2, showing a first form of embodiment of the safety ski binding according to the instant invention.

The shape and arrangement of these ramps 16 are such that the rod 14 resiliently urged by spring 9 constantly tends to rotate the end piece E in the closing direction F (see FIG. 1).

The vertical pivot member 4 comprises a second cam face 18 opposite the first cam face 7 in the longitudinal direction of the ski, this second cam face 18 being engaged by a second piston 19 slidably mounted within the body 3 and resiliently urged by the coil compression spring 9 against said second cam face 18.

In the form of embodiment illustrated and according to a specific feature characterizing the present invention, this second piston 19 consists of an open-sided frame or box like member housed within the body 3 and surrounding the pivot member 4, the first piston 8 and the spring 9. The cross rod 14 also extends through this second piston 19. The cam 18 consists of a flat face parallel to the flat face constituting the first cam 7, the inner end of piston 19 being resiliently urged against the second cam face 18 by the force of spring 9.

The above-described form of embodiment of the safety ski binding according to this invention operates as follows:

The spring 9 urges simultaneously the piston 8 against the flat face 7 constituting the first cam of pivot member 4, the piston 19 against the flat face 18 constituting the second cam of pivot member 4, and the rod 14 against the ramps 16. In brief, this spring 9 resiliently holds at the same time the body 3 in its normal position parallel to the longitudinal center line of the ski, as illustrated in FIGS. 1 and 2, and the end piece E in its closed or boot-retaining position (FIG. 1).

Figure 5:
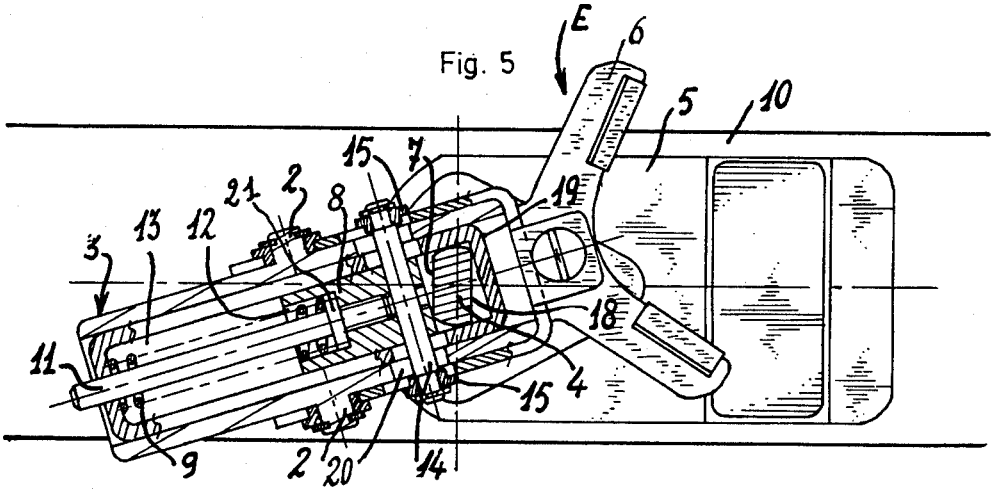
FIG. 5 is a view similar to FIG. 2, but showing the ski binding after a pivotal movement thereof through a certain angle about the vertical axis perpendicular to the ski surface.

When a relatively strong lateral effort is exerted against or by the skier's leg, for example as a consequence of a torsional fall, the body 3 is caused to rotate about the vertical pivot member 4, as illustrated in FIG. 5. The piston 8 is moved to the left as seen in FIG. 1 against the force of spring 9, and bears only against an edge of the flat cam face 7 while the piston 19 moves to the right and likewise bears only against one edge of cam 18 (FIG. 5). Therefore, a return torque is exerted between the pistons 8 and 19, on the one hand, and the pivot member 4, on the other hand, and tends to restore the body 3 to its normal position, at least as long as the amplitude of this angular movement does not exceeds a predetermined limit value. The movement of piston 8 is also attended by a movement of rod 14 which is thus moved away from its ramps 16. Under these conditions, the end piece 18 can pivot freely about the axis of trunnions 2 through an angle depending both on the angular amplitude of the movement of the body 3 and on the shape of said ramps 16.

Figure 4:
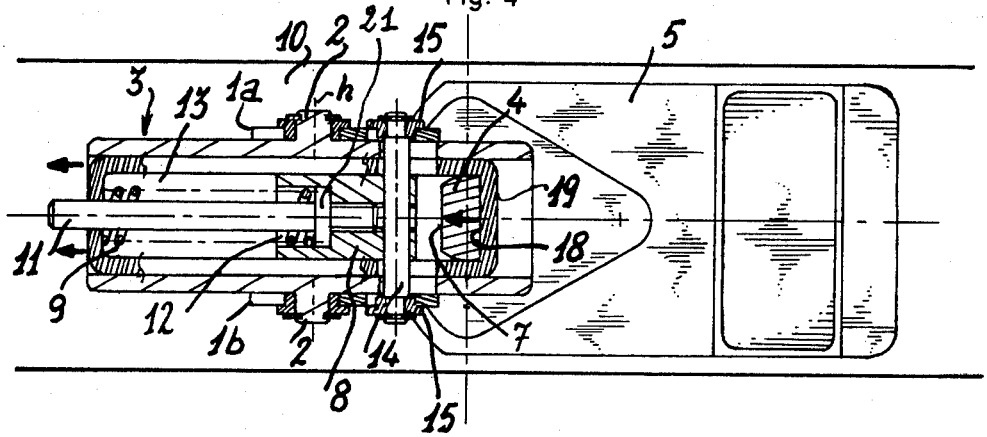
FIG. 4 is a plan view from above of a section taken along the line IV—IV of FIG. 3.

When a relatively strong vertical stress is exerted on the skier's leg, notably as a consequence of a backward fall of the skier, the end piece E is lifted in the opening direction 0 (FIG. 3), so that the piston 8 is moved away from the axis v (or to the left as seen in FIG. 1) via ramps 16 and rod 14, the latter sliding along said ramps 16. Consequently, piston 8 is moved to the left (FIG. 1) via ramps 16 and rod 14, the latter sliding along said ramps. Thus, piston 8 is moved away from the cam face 7 of pivot member 4, as shown in FIG. 4. On the other hand, the second piston 19 remains in engagement with the second cam 18 of fixed pivot member 4. As a result, a retaining torque is created which holds the body 3 against rotation and this force is subordinate to the magnitude of the resilient force exerted by the return spring 9 on piston 19.

This torsion torque increases slightly as the end piece E is lifted, due to the compression of spring 9. Under these conditions, the existence of this residual torque, and the frictional contact between the boot and the end piece E, hold the skier's boot sufficiently against rotation to warrant a satisfactory flexibility during the ski ride in case of vertical lifting of end piece E as a consequence of the accumulation of snow under the boot sole or when the skier is bent forwards.

In actual practice, measurements proved that the torque tending to hold the boot against rotation is substantially constant, irrespective of the degree of lifting of the sole off the ski.

The box-like configuration of the second piston 19 is most convenient for controlling the two pistons 8 and 19 by means of a common return spring 9.

In may be noted that instead of fixing the rod 14 to the piston 8, one could fix same to the box-like piston 19. By giving a suitable inclination to the ramps 16, it would thus be possible to obtain a similar operation of the ski binding, the piston 19 moving in this case away from the associated cam 18 in case of upward movement of the end piece E.

Figure 6:
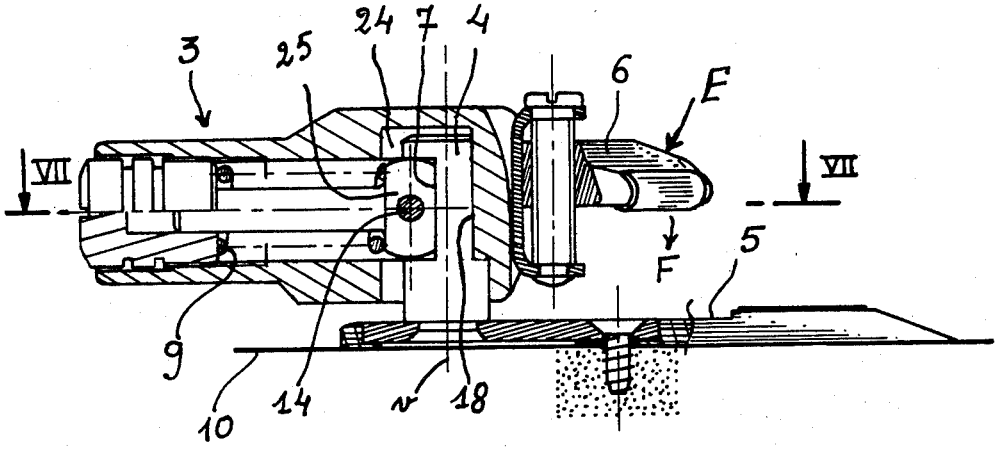
FIG. 6 is a vertical longitudinal section similar to FIG. 1 showing a second form of embodiment of the safety ski binding of this invention.
Figure 7:
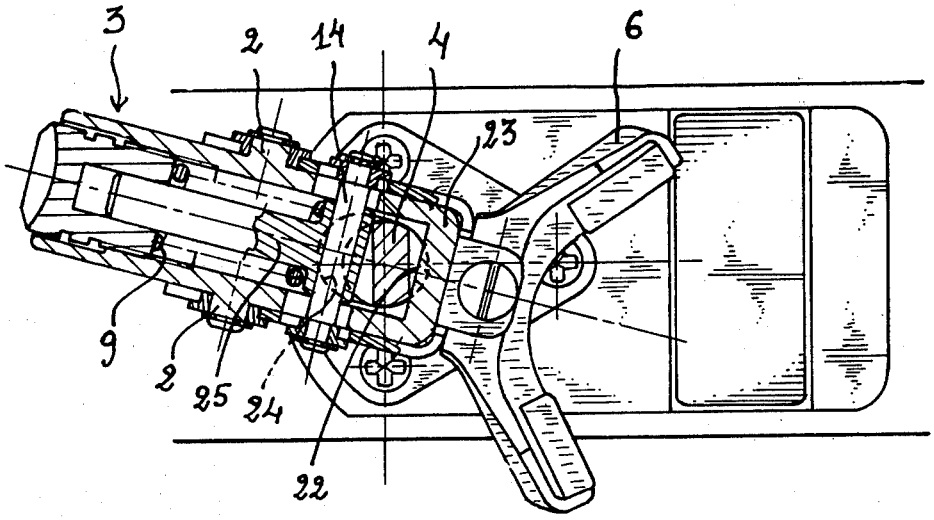
FIG. 7 is a section taken along the line VII—VII of FIG. 6.
Figure 8:
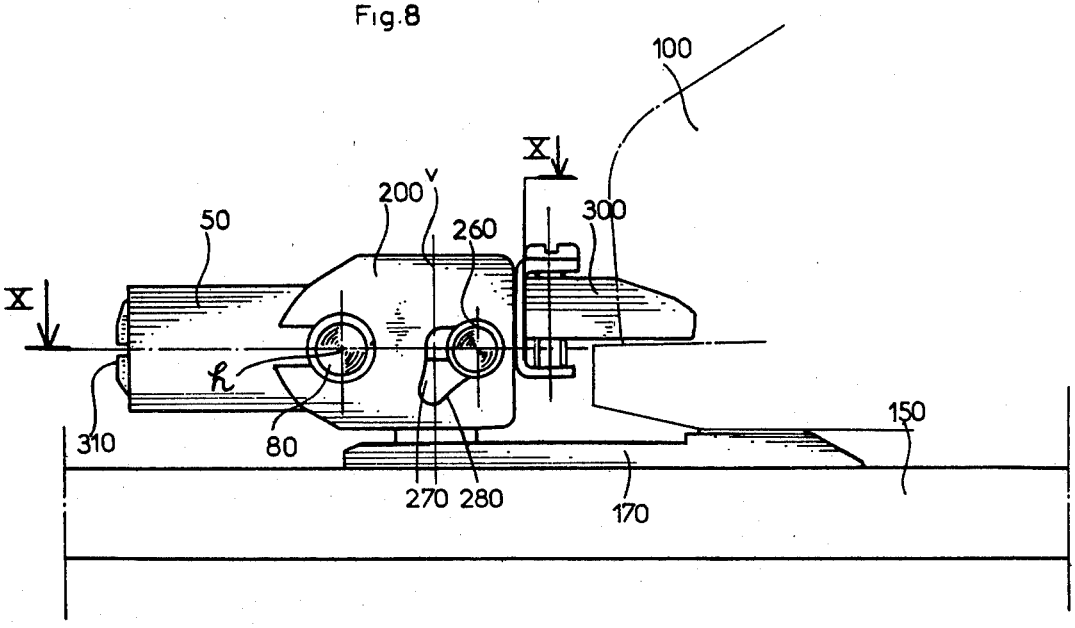
FIG. 8 is a side elevational view of a third form of embodiment of the safety ski binding of this invention, mounted on a ski.

The second form of embodiment of the ski binding according to this invention, as illustrated in FIGS. 6 and 7, differs from the preceding one in that one of the pistons, namely piston 22, is formed directly in the body 23, and that the frame 19 is dispensed with. This piston 22 consists in fact of a flat face formed in the body 23 and engageable by the cam 18 against which the piston 22 is urged by spring 9, the other piston 25 receiving the rod 14 therethrough being guided in the body 23 and also urged against the relevant cam face 7 by the common spring 9.

During its rotation about the pivot member 4, the body 23 is caused to move longitudinally and backwards in relation to the ski; to permit this movement, the pivot member 4 is disposed in an elongated bore 24 formed in the body 23.

It is clear that this modified construction constitutes a substantial simplification in comparison with the preceding one. Nevertheless, a particularly advantageous feature of this modified version is that it provides a very satisfactory resilient return force for returning the ski boot to its normal position, i.e. in alignment with the ski axis or center line, even if the longitudinal displacement of the ski binding (to adapt same to the boot size) were not made very accurately. Moreover, this ski binding absorbs lateral shocks particularly well without untimely release of the ski boot.

These properties are due to the fact that during the rotation of the ski binding body 23 the end piece is moved towards the boot, thus tending to compress the latter instead of releasing the same prematurely.

The third form of embodiment of the invention, illustrated in FIGS. 8 to 15 of the drawings, is also intended for cooperating with the toe end of a ski boot 100. However, it is clear that the same device could be used as a heel hold-down device, by properly modifying the end piece thereof, and completing it with boot release means controllable by the skier.

This ski binding comprises a U-shaped strap 200 supporting a jaw or end piece 300. The strap 200 is pivoted in the fashion of a yoke on the body 50 by means of a pivot pin or rod having its axis h disposed at right angles to the longitudinal center line of the ski, the body 50 being pivotally mounted in turn on a pivot member 60 secured to the ski 150 and extending at right angles from the top surface of the ski. Thus, the body 50 can rotate about the vertical axis v of pivot member 60, the term "vertical axis" designating an axis extending perpendicularly to the ski surface as in the preceding forms of embodiment, the "horizontal axis" h being of course perpendicular thereto.

The pivot member 60 is carried by a plate 170 fastened by means of screws (not shown) to the ski 150.

The horizontal axis h is coincident with that of a pair of spaced lateral trunnions 80 formed integrally with the body 50.

The body 50 is hollow to provide a cavity 90 in which the piston 130 is adapted to slide; this piston 130 is urged by a coil compression spring 110 reacting against a screw plug 310 screwed in the body 50. Thus, the piston 130 is pressed resiliently against a first cam 140 consisting of a flat face formed on the surface of pivot member 60 which is opposite the boot 100 and perpendicular to the ski 150. On the other hand, the body 50 is resiliently urged against another cam 160 formed on pivot member 60 on the side thereof facing the boot 100; thus, the single spring 110 presses on the one hand the piston 130 against one flat face 140 and the body 50 against the other flat face 160, thus holding the body 50 against torsion stresses and in alignment with the longitudinal center line of the ski.

The improved ski binding of this invention comprises means for moving the strap 200 and jaw 300 towards the ski boot 100 when the strap 200 is caused to rotate about one and/or the other horizontal and vertical axes h and v, respectively. In the form of embodiment illustrated in FIGS. 8 to 15 of the drawings these means are as follows:

The fixed pivot member 60 is housed within an elongated or oval sectioned bore 180 (see FIG. 9) formed in the body 50 so that the latter can not only rotate about the vertical axis v but also slide horizontally in relation to said fixed pivot member 60, i.e. parallel to the ski 150.

Figure 9:
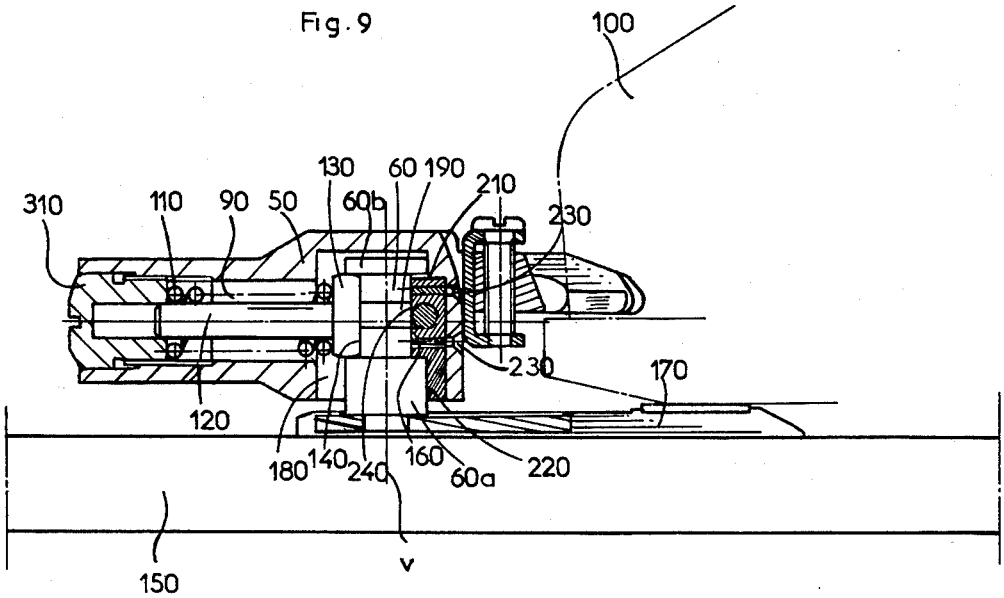
FIG. 9 is a vertical axial section taken along the line IX—IX of FIG. 10.
Figure 10:
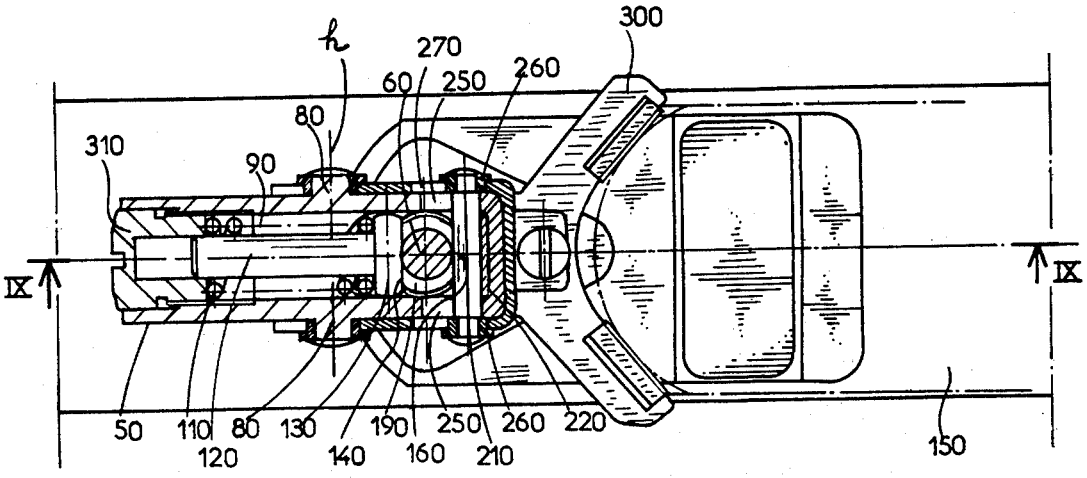
FIG. 10 is a plan view and horizontal section taken along the line X—X of FIG. 8.

In the example described herein the means for driving the body 50 and strap 200 towards the ski boot 100 comprise an annular groove 190 formed about the fixed pivot member 60, approximatively at mid-height between its base 60*a* and its flat head 60*b*, as clearly shown in FIG. 9. This annular groove 190 is truncated tangentially to its bottom by a pair of opposed vertical flat faces 140 and 160; a follower consisting of a transverse rod 210 is interposed between the flat face 160 opposing the piston 130 and a plate 220 secured to the bottom of said bore 180. The plate 220 consists of relatively hard material and is secured to the bottom of the body 50 for example by means of screws 230. This plate 220 comprises a flat face engaging the flat face 160, a transverse semi-cylindrical recess 240 being formed in said plate 220 for receiving the cylindrical rod 210 at the same level as said annular groove 190.

Figure 11:
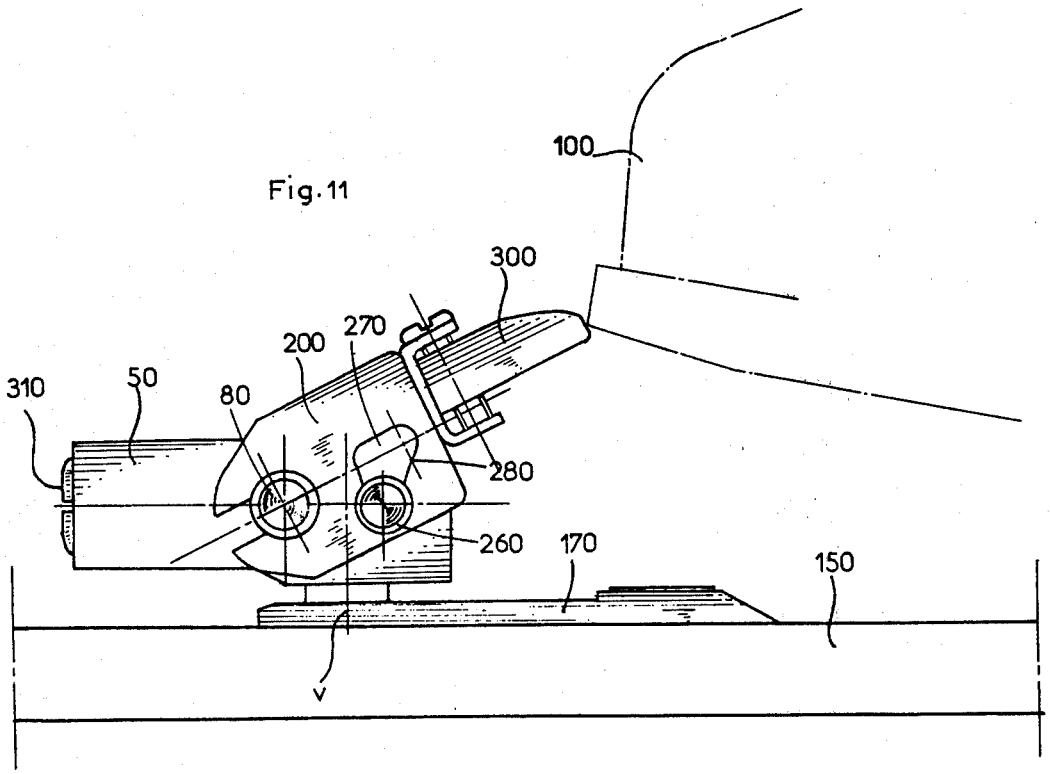
FIG. 11 is an elevational view similar to FIG. 8, showing the ski binding during the release of the ski boot subsequent to an upward movement thereof, just after the boot has been released from the binding.

The ends of rod 210 are guided for translation in elongated apertures 250 formed in the body 50 (FIG. 10) and carry anti-friction rollers 260 engaging lateral apertures 270 formed in the side arms of strap 200. These rollers 260 actually engage inclined ramps 280 formed on one side of each lateral aperture 270 (FIG. 11). The inclination of these ramps 280 is such that the member 200 is normally held in its lowermost position (see FIG. 8) by the force of spring 110.

The annular groove 190 according to this invention has a semi-circular cross-sectional contour, and the diameter of the cross rod 210 is equal to the depth of its recess 240 formed in plate 220, and also to the diameter of said groove 190.

It is thus clear that the single spring 110 is capable of resiliently retaining the body 50 against torsional movements in relation to the fixed pivot member 60, and the strap 200 together with its jaw 300 against rotation about the trunnions 80, i.e. about the horizontal axis h.

Figure 12:
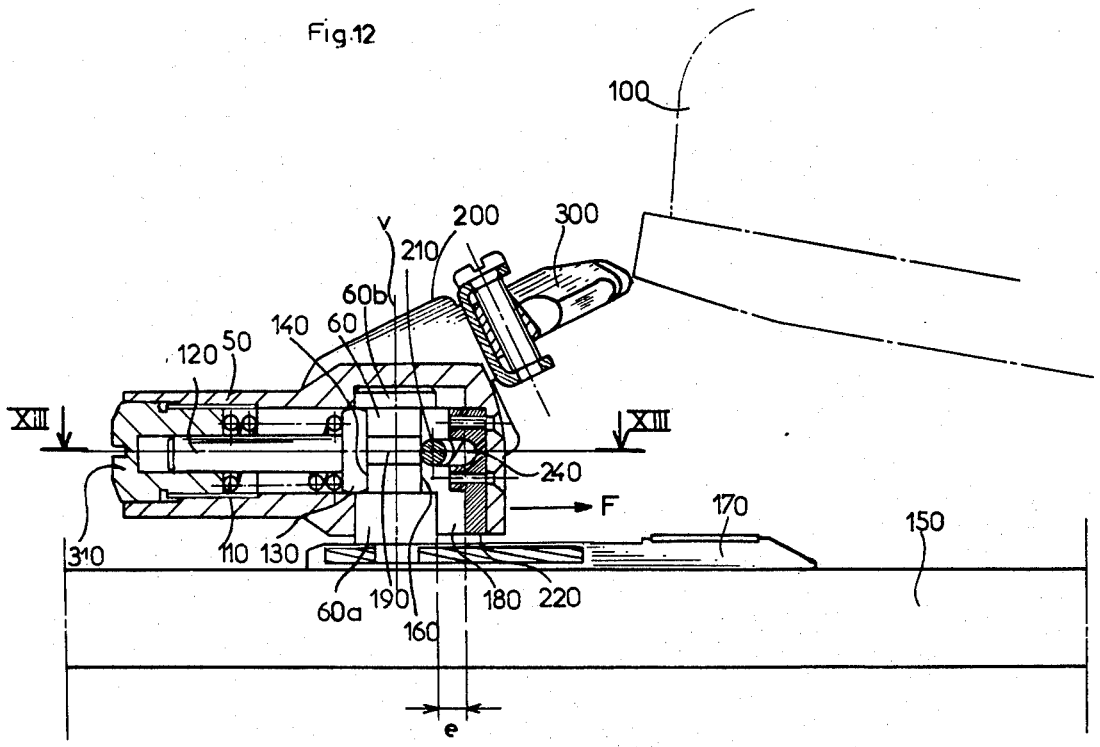
FIG. 12 is a side elevational and axial section corresponding to FIG. 11.
Figure 13:
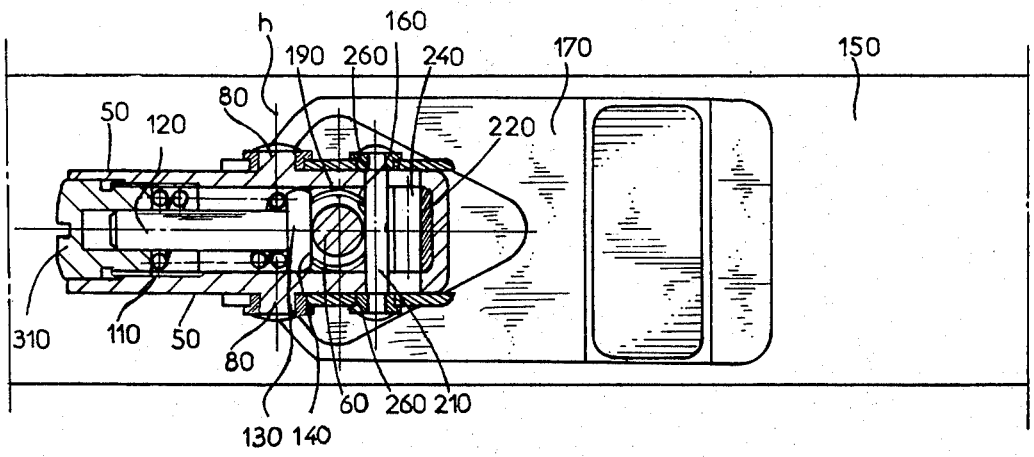
FIG. 13 is a section taken along the line XIII—XIII of FIG. 12.

The safety ski binding according to the above-described form of embodiment operates as follows:

(1) In case of backward fall of the skier (cf. FIGS. 11, 12 and 13):

The strap 200 and jaw 300 are lifted, and ramps 280 tend to move the transverse rod 210 to the left, as seen in the Figures, i.e. away from the boot 100. However, the rod 210 abuts the fixed pivot member 60. Consequently, the ramps 280 and therefore the strap 200 and body 50 will move towards the boot 100. This movement is permitted by the elongated shape of the bore 180 inside the body 50. This movement towards the boot 100 as shown diagrammatically by the arrow F in FIG. 12 ends of course when the base plate 60*a* of the fixed pivot member 60 abuts the bottom of the ovalized bore 180. At this moment the boot 100 is just released from the binding, as shown in FIG. 12. At the end of this movement, the assembly comprising the body 50, strap 200 and jaw 300 has followed the backward movement of the boot along a distance denoted e which corresponds to the permissible movement of pivot member 60 in bore 180. Thus, the jaw 300 will tend to follow the boot 100 along a relatively long release stroke.

It will be noted that when the jaw 300 moves upwards, the plate 220 is no longer in engagement with the flat face 160, due to the movement of the body 50 towards the boot 100. Only the piston 130 will hold the body 50 against rotation. In case of backward fall, it is thus obvious that the resistance of the device to torsion stresses is decreased, the return torque being divided approximatively by two. On the other hand, it may be noted that the cross rod 210 does not interfere with the rotation of the body 50, due to the existence of the annular groove 190 in which it is engaged.

Figure 14:
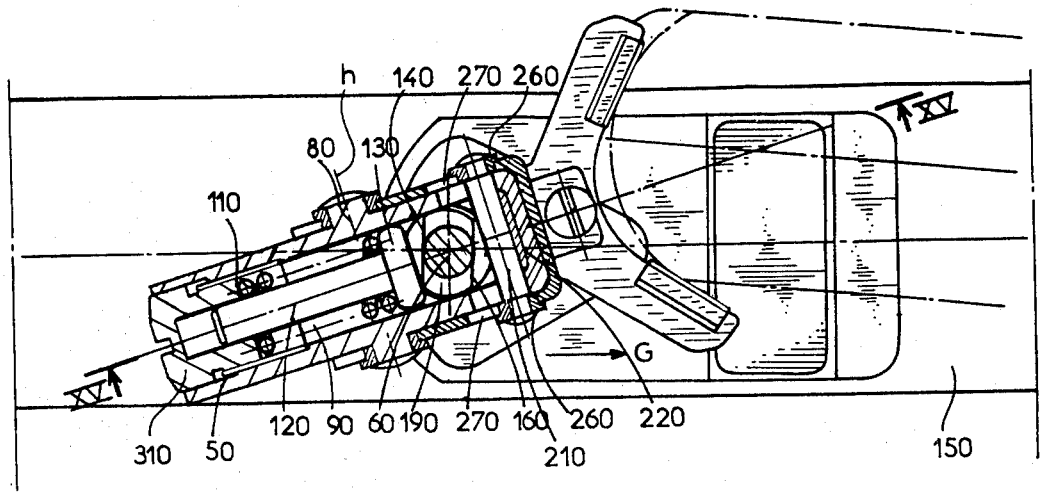
FIG. 14 is a horizontal section and plan view from above similar to FIG. 10, showing the positions of the component elements of the binding during a release due to an excessive torsional movement.
Figure 15:
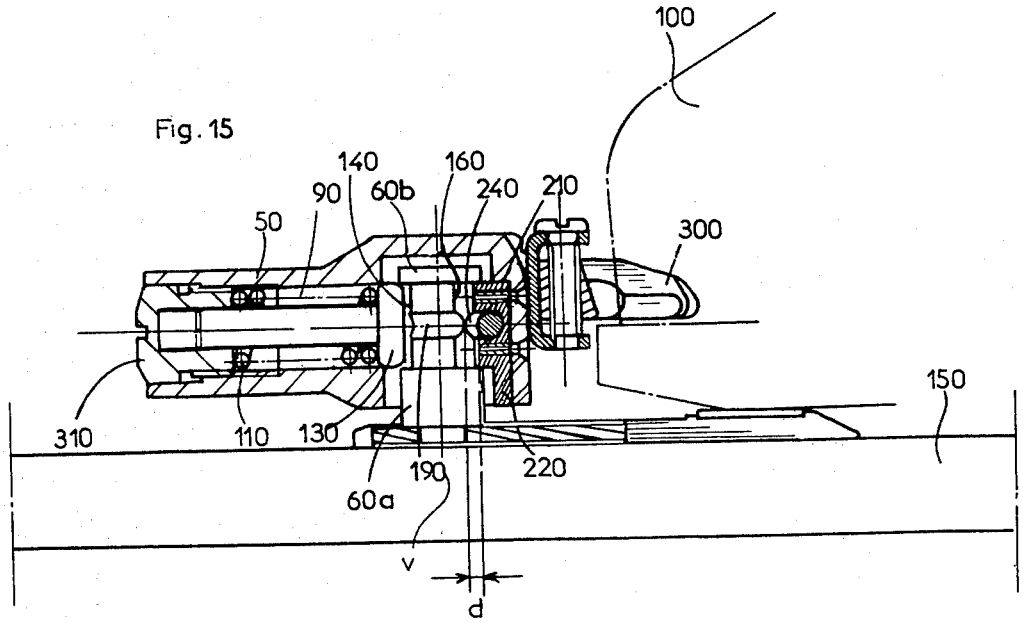
FIG. 15 is a vertical section taken along the line XV—XV of FIG. 14.

(2) Behavior of the ski binding in case of torsion stress (FIGS. 14 and 15).

When the body 50 pivots about the vertical axis v, the piston 130 and plate 220 are moved, the former away from, and the latter towards, the boot 100, respectively, by the flat faces 140 and 160 associated therewith. The body 50 and the jaw 300 carried thereby are thus moved toward the boot 100 (as shown by the arrow G in FIG. 14). Consequently, also in case of torsion stress, the jaw 300 tends to follow the boot along a relatively long stroke.

When the body 50 has pivoted about the axis v, the rod 210 can move freely through a distance d (FIG. 15) corresponding to its permissible free movement between its position of engagement with the bottom of the recess 240 formed in the plate 220 and its position of engagement with the bottom of groove 190. Correlatively, the jaw 300 can pivot freely through a predetermined angle proportional to the angle of rotation of the body 50, and this can be regarded as a valuable feature of the present invention in connection with the skier's safety.

(3) Composite movement combining a torsion with a backward fall:

The two above-described effects are combined together, with strap 200 and jaw 300 moving toward the ski boot 100 so as to follow the latter along a relatively considerable stroke.

The last-described form of embodiment of the present invention provides a very satisfactory resilient return in any direction. It is also rather insensitive to an inaccurate longitudinal adjustment and therefore adaptable to different ski boot sizes without requiring any precision adjustment of the device.

This invention should not be regarded as being strictly limited to the forms of embodiment described hereinabove and shown in the attached drawings, since many modifications and variations may be brought thereto without departing from the basic principles of the invention as set forth in the appended claims. Thus, the pair of cams formed on the vertical pivot member could be replaced by a pair of recesses of same or different depths, adapted to receive balls. Another possible modification may consist in providing a piston and flat-face assembly on one side of the pivot member, and a ball-and-notch assembly on the opposite side.

Additionally, the end piece may consist of a lock bolt co-acting directly or not with the end of the ski boot, but with a plate detachably mounted to the bottom surface of the boot.

What is claimed as new is:

1. A safety ski binding comprising:

a vertical pivot member adapted for mounting on and substantially perpendicular to the surface of a ski and defining a vertical axis, said pivot member including a pair of diametrically opposed cam means;

a body rotatably mounted for pivotal movement about said vertical pivot member in a first direction substantially parallel to the surface of the ski;

a rigid end piece for cooperative engagement with one end of a ski boot and pivotally connected to said body about a horizontal axis lying transverse to the elongation of the ski for pivotal movement in a second direction substantially perpendicular to the surface of the ski and said first direction, said end piece including at least one ramp;

a pair of pistons movable in the longitudinal direction of the ski;

a resilient member interposed between said pistons for urging each said piston into engagement with a respective one of said cam means; and a follower disposed for engagement with said at least one ramp of the end piece and with one of said pistons and for relative movement with respect to said body such that said follower causes movement of said one piston away from the associated cam means on pivotal movement of said end piece about said horizontal axis.

2. A safety ski binding according to claim 1 wherein each said cam means comprises a flat face disposed along the vertical axis of said pivot member and transverse to the elongation of the ski, and each of said pistons includes a flat portion adapted to cooperate with a respective one of said flat faces.

3. A safety ski binding according to claim 2 wherein one of said pistons is an integral portion of said body, said body having an elongated bore for mountably receiving said vertical pivot member and enabling relative movement of said body with respect to said vertical pivot member, and the other piston being movable within said body said ski binding further comprising means for moving said end piece toward the ski boot when said end piece is caused to rotate about said horizontal and vertical axes.

4. A safety ski binding according to claim 2 wherein one of said pistons is a fixed insert in relation to said body, said body including an elongated bore for mountably receiving said vertical pivot member and enabling relative movement of said body with respect to said vertical pivot member, and the other piston being movable within said body, said ski binding further comprising means for moving said end piece toward said ski boot when the boot is caused to rotate about said horizontal and vertical axes.

5. A safety ski binding according to claim 2 wherein one of the pistons is an integral part of said body, the other piston being movable within said body, and said body includes an elongated bore for mountably receiving said vertical pivot member and enabling relative movement of said body with respect to said pivot member, said ski binding further comprising means for moving said end piece toward the ski boot when the boot is rotated about one of said horizontal and vertical axes.

6. A safety ski binding according to claim 2 wherein one of the pistons is a fixed insert fitted in said body, the other piston being movable within said body, and said body includes an elongated bore for mountably receiving said vertical pivot member and enabling relative movement of said body with respect to said pivot member, said ski binding further comprising means for moving said end piece toward the ski boot when the boot is caused to rotate about one of said horizontal and vertical axes.

7. A safety ski binding according to claim 1 wherein said end piece includes a second ramp and a substantially U-shaped strap portion, each of said ramps being formed in a respective one of the side arms of said U-shaped strap portion such that the strap portion is fulcrumed on said body.

8. A safety ski binding according to claim 7 wherein said follower comprises a rod extending transverse to the elongation of the ski and adapted to cooperate with said ramps at the respective ends of said rod.

9. A safety ski binding according to claim 8 wherein said rod is carried by one of said pistons and extends through said one piston so as to project from either side thereof.

10. A safety ski binding according to claim 8 wherein said rod is interposed between one of said pistons and its associated cam means.

11. A safety ski binding according to claim 10 wherein each of said cam means comprises a flat face on said vertical pivot member, one of said pistons is an integral part of said body, the other piston being movable within said body, said body including an elongated bore for mountably receiving said vertical pivot member and enabling relative movement of said body with respect to said pivot member, and a flat portion on said body for engagement with one of the flat faces of said vertical pivot member, said flat portion on said body including a recess directed toward said one flat face and receiving said follower rod, and said vertical pivot member having defined therein an annular groove truncated tangentially to its bottom by said flat faces such that movement of said end piece along said vertical axis causes said rod to engage the bottom of said annular groove without interfering with the pivotal movement of said body.

12. A safety ski binding according to claim 1 wherein one of said pistons comprises a box-like member guided for translation in said body and encompassing said vertical pivot member, the other piston, and said resilient member.

13. A safety ski binding according to claim 1, further comprising means for moving said end piece toward the ski boot, when said end piece is caused to rotate about one of said horizontal and vertical axes.

14. A safety ski binding as recited in claim 1, further comprising means for moving said end piece toward the ski boot when said end piece is caused to rotate about said horizontal and vertical axes.

* * * * *